US005148868A

United States Patent [19]

Christian

[11] Patent Number: 5,148,868

[45] Date of Patent: Sep. 22, 1992

[54] METHOD AND APPARATUS FOR PERFORATING TUBING

[76] Inventor: J. B. Christian, Rte. 9, Box 630, Laurel, Miss. 39440

[21] Appl. No.: 743,861

[22] Filed: Aug. 12, 1991

[51] Int. Cl.[5] ..... E21B 43/116

[52] U.S. Cl. ..... 166/297; 166/55; 89/1.15; 102/275

[58] Field of Search ..... 166/297, 55, 55.1, 63, 166/299; 102/530, 531, 275; 89/1.15; 175/4.56

[56] References Cited

U.S. PATENT DOCUMENTS

| | | | |
|---|---|---|---|
| 2,876,843 | 3/1959 | Huber | 175/4.56 |
| 3,706,344 | 12/1972 | Vann | 166/297 |
| 4,512,406 | 4/1985 | Vann et al. | 166/297 |
| 4,566,544 | 1/1986 | Bagley et al. | 166/297 X |
| 4,624,307 | 11/1986 | Kinley et al. | 166/55.3 |
| 4,632,034 | 12/1986 | Colle, Jr. | 166/63 X |
| 4,911,251 | 3/1990 | George et al. | 175/4.56 X |

*Primary Examiner*—Stephen J. Novosad

[57] ABSTRACT

The invention, as set forth in this disclosure, includes a perforating assembly for perforation of well tubing. This perforating assembly can be dropped by hand without attachments of any kind. The outside diameter of this manually-dropped tubing perforating assembly allows it to free fall within tubing to the plug or pump near the bottom of a well. It incorporates a firing head with secured frangible pin and only one moving part; and it can be detonated mechanically. After this apparatus reaches a plug or pump near the bottom of a well, an impact bar can be dropped by hand to hit the apparatus. This detonates an explosive charge which blasts a hole through the tubing. The apparatus remains in the tubing on top of the plug or pump, so when the tubing is pulled from the well, the apparatus is retrieved along with the tubing. The use of electric wireline or slickline operations to lower and to retrieve a perforator from a well is eliminated with the use of this invention.

5 Claims, 3 Drawing Sheets

METHOD AND APPARATUS FOR PERFORATING TUBING

BACKGROUND OF THE INVENTION

The present invention relates to methods and apparatus for perforating tubing inside a subsurface well, and more specifically to previously unknown manually-dropped perforating assemblies for use in perforating tubing inside a well.

Drilling wells has been fairly standard, that is, a hole is drilled and casing is installed and tubing is placed inside the casing to convey the production to the surface. The uses of perforators in the drilling of wells and in the servicing of wells already in production are manyfold.

Certain types of perforators are used to perforate holes in casing in order to start production. Such perforators are lowered to the firing point using one of three methods: lowered by an electric wireline, lowered by a slickline, or attached to the end of tubing and lowered through the casing. The latter is generally referred to as a tubing-conveyed perforator or gun. Perforators of casing are fired by an electrical firing system; by use of a drop bar, commonly referred to as a "go devil" system; or some type of hydraulic system. The expended perforator is then returned to the surface using one of the following methods: by an electric wireline or a slickline, or pulled to the surface along with the tubing string. And, in some cases, the perforator is released into the bottom of the well and left in an area of the wellbore below the production zone called the rat hole.

Occasionally, casing perforators are used to create a borehole at a precise depth in only the tubing in order to enhance production. Only rarely are such perforators used to perforate both tubing and casing.

Another use of perforators, other than in drilling operations, is in the servicing of producing wells. Frequently, it is necessary to perforate the tubing, within a well casing, so that trapped fluids can drain and escape from the tubing prior to the pulling of the tubing string from a well. Wells with plugged tubing require the tubing string to be pulled from the well. Therefore, inventors created perforating guns designed to make drain holes in the tubing, but not the casing, through use of a controlled explosion. Explosive perforating guns such as that disclosed in U.S. Pat. No. 4,624,307 to Kinley et al (1986) have been used to penetrate tubing.

Prior to this present invention, all known tubing perforators used for creating drain holes in tubing have been lowered into firing position by means of a wireline; either an electric wireline or a slickline. After detonation, such perforators have to be retrieved from the well before the tubing string can be pulled from the well. It is only after the tubing is pulled that the necessary steps can be taken to get the well back into production.

It is also possible to pull tubing from a well without draining the fluids from the tubing. And, pulling tubing without a drain hole is less costly than using a perforator which must be lowered by wireline. But, several problems occur when tubing is pulled without a drain hole. The time required to pull tubing out of a hole is increased due to the problem of trying to contain the fluids trapped in the tubing. A bucket designed to wrap around the connections of the tubing can be used. A hose is attached to the bottom of the bucket at one end with the other end attached to a tank which is mounted on a truck. When a tubing string section is unscrewed from another section, the fluids trapped inside flow into the tank. Some of the fluids invariably spill onto the surface. Clean up of such spillage is mandated by state regulation, and if contamination occurs outside the location of the well, clean up is mandated by the Environmental Protection Agency.

This present invention provides a perforating assembly which is less costly than wireline perforators and is even less costly to use than pulling tubing without a drain hole.

This invention provides a new perforating assembly which is manually dropped into well tubing from the surface. The firing mechanism of this tubing perforator has a frangible pin which is sheared when a detonating bar is dropped down the tubing. The resulting detonation perforates the tubing creating a drain hole. The design and method of use of this manually-dropped perforator permits the removal of the tubing string without the need to retrieve it in a separate step.

Heretofore known tubing perforators suffer from a number of disadvantages which result in a loss of production time. The following describes these disadvantages and provides the reasons the manually-dropped perforator is less costly to use:

(a) The hiring and rigging up of a wireline truck requiring two people, one wireline operator and one helper, is needed to use heretofore known perforators. Rigging the truck for the use of a wireline perforator is a step which is not required when the manually-dropped perforator is used.

(b) Wire slows the fall of a wireline perforator because of the drag caused by friction on the wire traveling through the well fluids and because of the drag of the wire on the inside of the tubing. So, the wire is lowered at a slower rate than the rate the manually-dropped perforator will fall.

(c) A wireline perforator may become stuck because its outside diameter is relatively larger than the diameter of the manually-dropped perforator. This can occur when the tubing is not fully open from the surface to the area where the tubing is plugged or when there are tight places in the tubing. The time-consuming process of retrieving the wireline perforator and lowering a second perforator is required when the first one does not reach the appropriate detonation point in the tubing string. The manually-dropped perforator is small enough to fall freely even if the tubing is not fully open.

(d) Another disadvantage of a wireline perforator is the problem of downhole pressure which can occur in the tubing when the wireline perforator is detonated. Fluid pressure between the casing and the tubing can be greater than the pressure inside the tubing. When a wireline-conveyed perforator is used to create a drain hole in the tubing, the release of this greater fluid pressure into the tubing drives the wireline-conveyed tool and the wireline itself upward. This causes tangled wireline and lost tools. The wireline and the tools almost always are left in the well. This problem simply does not exist with the manually-dropped perforator as there is no wire involved.

(e) Wireline perforators which use solid bullets, such as that disclosed in U.S. Pat. No. 4,624,307 to Kinley et al (1986) can become lodged in the tubing. This occurs when the bullets do not fully penetrate the tubing when fired, thus causing such perforator to become stuck in the tubing. In such cases, the wire must be cut and a second wireline perforator lowered into the well. This is a time-consuming process. The reliability due to the method of use of a Jet charge in the manually-dropped perforator avoids this problem.

(f) A second perforator may need to be lowered when the firing head on a wireline perforator malfunctions, a problem which occurs because the firing heads of heretofore known perforators are comprised of several moving parts. This problem is alleviated when the manually-dropped perforator is used because it is designed with only one moving part.

(g) Following perforation of tubing with the use of a wireline perforator, it is not possible to immediately start pulling the tubing from the well. This is because the wire and the perforator must be pulled out of the well before the tubing string can be pulled out. With the manually-dropped perforator, no wire is involved and the perforator does not need to be retrieved in a separate step, as it is raised with the tubing when the tubing is pulled out of the hole.

(h) With the use of an electrically detonated wireline perforator, workers can be injured when premature firing occurs due to electrical interference, such as radio waves. This invention is mechanically detonated, so such premature firing cannot occur.

ADVANTAGES OF THIS INVENTION

Accordingly, several advantages of this invention are to provide:

(a) A tubing perforator which is designed to be dropped manually into the tubing of a well by only one worker and without the need for a wireline truck and a wireline operator, the result being an extremely rapid method and economical process for perforating tubing;

(b) A tubing perforator which will rapidly fall to the desired depth in a well because no wire must be attached to slow the fall of the perforating assembly;

(c) A tubing perforator which has an outside diameter which is small enough to allow the perforator to pass through minor restrictions in the tubing, so that it reaches the desired depth more quickly and with less possibility of becoming lodged in the tubing;

(d) A tubing perforator which is not affected by any differences in pressure between the casing and tubing and the pressure inside the tubing, because no wire is in the well to become entangled due to such changes in pressure;

(e) A tubing perforator which can be detonated manually by dropping a solid round bar into the tubing to fire a Jet charge thus providing a much more reliable firing mechanism, thereby avoiding the problem of the perforator becoming lodged in the tubing;

(f) A tubing perforator which has a firing head and a secured firing pin designed with only one moving part, resulting in a firing system that is extremely reliable; therefore, alleviating the need to lower a second perforator due to a malfunction of the first, which is a time-consuming process;

(g) A tubing perforator which is retrieved from a well along with the tubing so that time-consuming steps are not required to pull the perforator and related tools from the tubing before the tubing can be pulled from a well;

(h) A tubing perforator which is designed with a firing head and secured firing pin which can be detonated mechanically thus alleviating the problems with premature firing which can occur with the use of electrically detonated perforators.

Draining fluid from tubing before tubing is pulled from a well eliminates the problem of contamination of the soil from spilling fluids onto the ground at the surface, thus eliminates the time-consuming, and therefore costly, legally-mandated clean up. Because the manually-dropped perforator takes less time and less labor to use, it is a more efficient and less costly method of draining fluid from well tubing. Getting wells back into production is extremely important. For example, due to the demand for oil, oil producers can suffer significant financial loss when wells are out of production.

Further, it is believed that this manually-dropped perforator can be used to perforate the tubing of oil and gas wells which are on fire. Low pressure wells are candidates for the manually-dropped perforator because it does not require a wireline to lower it into the well. When the tubing has been perforated, fluid trapped between the casing and the tubing in the well will escape. These escaping fluids will extinguish the fire.

OBJECTS OF THE INVENTION

It is a principal object of the invention to eliminate the use of an electric wireline or a slickline to lower a perforator into a well through a tubing string. Another object is to eliminate the need to retrieve a perforator before the tubing string can be pulled from a well. This invention is a manually-dropped perforating assembly which achieves these and other objects.

SUMMARY OF THE INVENTION

This invention is a perforating assembly with an outside diameter which permits it to be manually dropped into a tubing string allowing it to reach the appropriate point, typically a pump or an obstruction, in a well in a matter of minutes rather than hours required when a perforator is lowered via a wireline operation. This manually-dropped perforating assembly is comprised of several machined parts used with an expendable hollow charge carrier and a charge holder. In a preferred embodiment, the firing mechanism of said assembly is detonated mechanically. Said assembly has a frangible pin which is sheared when a detonating bar is dropped down a tubing string. The resulting detonation perforates the tubing creating a drain hole. Following detonation, the tubing string can be pulled from the well. The perforating assembly does not need to be retrieved from the well before the tubing string can be pulled from the well. Said assembly, though unattached, will ride within the tubing on top of a pump or a plug when the tubing string is pulled from the well. Therefore, said assembly will be retrieved from within the tubing after the tubing string reaches the surface.

In another embodiment, the perforating assembly can be dropped from the surface with the firing mechanism pointed downward. Detonation will occur when said assembly hits the obstruction. Removal of said assembly from the well occurs in the same manner as in the preferred embodiment summarized above.

BRIEF DESCRIPTION OF THE DRAWINGS

In the drawings, closely related figures have the same number but different alphabetic suffixes.

Reference Numerals in Drawings

Figure 1:
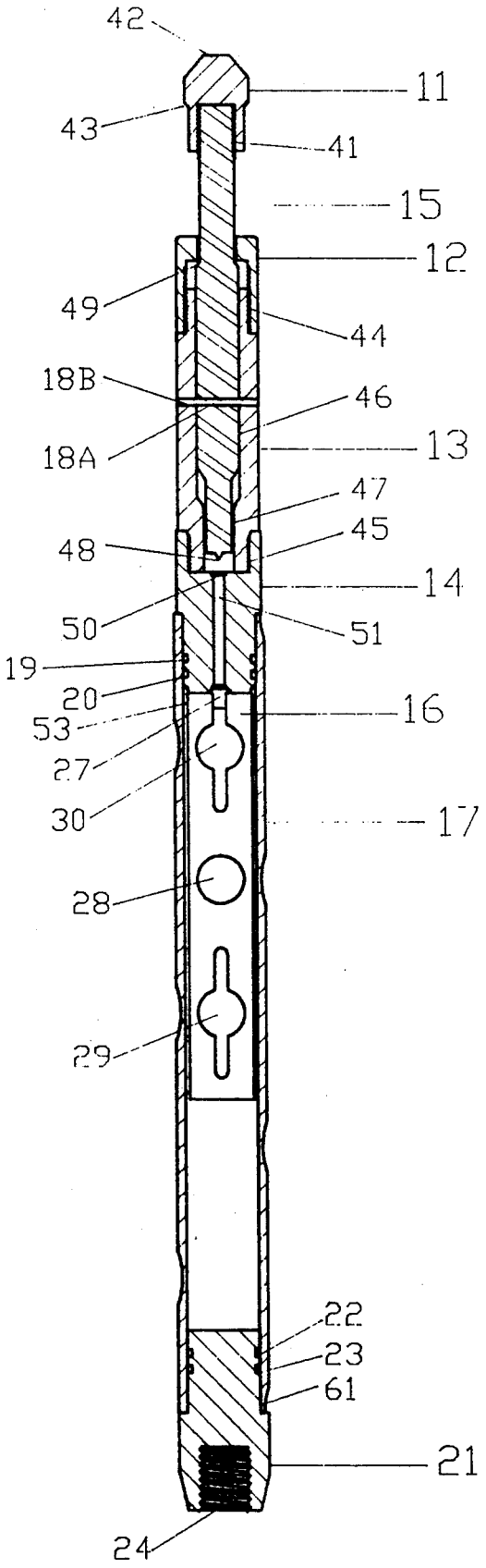
FIG. 1 shows the entire perforating assembly in a longitudinal sectional view, including the percussion firing assembly and the charge holder and carrier assembly; illustrating the firing pin prior to detonation without a detonator and detonating cord and without a charge.

11 fishing neck
12 firing pin holder cap
13 firing pin holder
14 shell holder
15 firing pin
16 charge holder—JRC Part No. T20072-4 can be used
17 expendable hollow charge carrier—JRC Part No. T20019
18A hole for frangible pin
18B hole for frangible pin
19 O-ring groove
20 O-ring groove
21 bull plug
22 O-ring groove
23 O-ring groove
24 threaded end of bull plug
27 unthreaded end of shell holder
28 circular cutout in charge holder
29 circular cutout in charge holder
30 circular cutout in charge holder
41 threaded end of firing pin
42 top of fishing neck
43 shoulder of fishing neck
44 threads at top of firing pin holder
45 threaded bottom end of firing pin holder
46 larger I.D. of firing pin holder
47 smaller I.D. of firing pin holder
48 pinpoint extension on bottom of firing pin
49 top end of firing pin holder
50 top of vertical hole in center of shell holder
51 vertical hole in center of shell holder
52 slot in bottom of shell holder
53 screw holes at bottom of shell holder
54 shallow hole in center of end of shell holder
60 screw holes above O-ring grooves in shell holder
61 screw holes below O-ring grooves in bull plug
70 vertical hole in center of top of firing pin holder cap
71 space between firing pin holder cap and firing pin and firing pin holder
72 space between firing pin and firing pin holder when in armed position
73 space between bottom of firing pin and detonator when in armed position
74 O. D. of firing pin at its middle portion

DETAILED DESCRIPTION OF THE PREFERRED EMBODIMENT

It is an object of this invention to provide one or more of the following desirable features not heretofore known or used:

1. A perforating assembly wherein a perforator containing an explosive charge is simply dropped by hand into the tubing string of a well and an impact bar is dropped into the tubing string after the perforator reaches the appropriate point, a pump or a plug; the impact bar causing detonation, thus creating a drain hole in the tubing so that the tubing string can be removed without fluid being retained therein;

2. A perforating assembly that has only one moving part, the firing pin, which is held in place by a frangible pin until the perforator is in place and the force of the impact bar shears the frangible pin and detonates the charge;

3. A perforating assembly which stays in the tubing string until the drained tubing string is removed from the well at which time the tool can be recovered;

4. A perforating assembly which saves well servicing time and expense by permitting producing wells to be serviced and returned to a production mode in the least possible time because the ability to create drain holes in tubing and to remove tubing string is no longer dependent upon use of wireline field servicing units, whether electrical or mechanical.

These and other specific objects will be apparent from the following descriptive matter when taken in conjunction with the drawings.

Referring now to the drawings, FIG. 1 shows a longitudinal sectional view of the manually-dropped perforating assembly machined from cylindrical lengths of solid metal and attached to a charge holder and carrier assembly.

A fishing neck 11 is drilled and threaded 41 at the bottom. This fishing neck 11 screws onto the top of the firing pin 15 and is adapted to receive on its top 42 the impact from a dropped impact bar, not illustrated. Said fishing neck 11 is adapted for suspension from a wireline at shoulder 43 to provide added versitility of use with a wireline if an unusual circumstance arose.

The firing pin holder 13 is used to receive a firing pin 15 and is placed on top of a shell holder 14. The Outside Diameter, O. D., of the firing pin holder 13 is threaded on top 44 to receive a firing pin holder cap 12 and the O. D. of the other end is threaded 45 so that the firing pin holder 13 can be screwed into the shell holder 14.

The firing pin holder 13 is drilled vertically in its center from its upper end to produce an Inside Diameter, I. D., 46 which is slightly larger in diameter than the firing pin 15; and at the other end is drilled vertically in its center to produce a slightly smaller I. D. 47 so that the firing pin 15 can come into contact with a 0.22 Hornet detonator, not illustrated, in the shell holder 14.

A firing pin holder cap 12 must be placed at the top end of the firing pin holder 13, so a vertical hole is drilled in the center of the cap 12. The I. D. of said hole is slightly larger than the upper end of the firing pin 15, so the firing pin holder cap 12 will slide onto the firing pin 15 after the firing pin 15 is inserted into the firing pin holder 13. The pin holder cap 12 is threaded 44 so that it will screw onto the top of the holder 13. When the cap 12 is screwed into place, the firing pin 15 is prevented from being removed from the holder 13.

The firing pin 15 is machined from an elongated cylindrical length of solid metal, fashioned at the bottom end 48 with a small pinpoint-shaped extension. Said extension 48 will hit the 0.22 Hornet detonator in the shell holder 14.

The unthreaded bottom end 47 of the firing pin 15 is placed into the top 49 of the firing pin holder 13 by inserting this smallest end 47 into the top 49 of the pin holder 13.

The upper end of the firing pin 15 has an O. D. of a size slightly smaller than the middle portion of the pin 15. This is done so that the firing pin 15 will accept the firing pin cap 12 by sliding the cap 12 down over the upper end of the firing pin 15. The largest O. D. of the firing pin 15 is its middle portion 46, so that the firing pin 15 will remain in place inside the pin holder 13 when the cap 12 is screwed onto the holder 13.

The firing pin 15 is threaded at the top end 41 to receive the fishing neck 11. The fishing neck 11 and the firing pin 15 receive the impact from a dropped impact bar.

The firing pin 15 is machined to accept a frangible pin, not illustrated. This is accomplished by drilling a hole 18A in the firing pin 15 horizontally in the middle portion to produce a hole 18A of a size to accept the frangible pin. This hole 18A must be lined up with a hole 18B which is drilled horizontally through the firing pin holder 13, so that the frangible pin can be inserted through both the firing pin 15 and the pin holder 13. This alignment of the firing pin 15 and the pin holder 13 allows the frangible pin to be inserted as a safety measure to ensure an accidental firing of the perforating assembly does not occur prior to use of an impact bar.

The shell holder 14 is placed below the firing pin holder 13 and above a charge holder 16. The shell holder 14 is adapted to receive a 0.22 Hornet detonator from the top 50 and a detonating cord, not illustrated, is pushed through a vertically drilled hole 51 in the center of the shell holder 14 so it comes out the bottom 27 of said shell holder 14.

The shell holder 14 is milled at the bottom end to produce a slot bisecting said end, and Allen head set screw holes are drilled near the bottom of the shell holder 14. This enables the charge holder 16 to be held in place near the bottom 53 of the shell holder 14 by one set of Allen head set screws.

The shell holder 14 has an O. D. at its bottom end which enables it to be placed into an expendable hollow charge carrier 17 and held in place with a set of Allen head cap screws.

The shell holder 14 is machined to accept two O-rings, rings not illustrated, near the bottom of the holder 14 so a tight seal is formed 19 and 20 when the firing assembly is inserted into the charge carrier 17. The shell holder 14 is threaded at the top 45 with an I. D. which will receive the firing pin holder 13.

The charge holder and carrier assembly includes an expendable hollow charge carrier 17, a charge holder 16, and a bull plug 21.

The expendable hollow charge carrier 17 is adapted at its top end to receive the shell holder 14, and adapted at its lower end to receive a bull plug 21 to be secured by Allen head cap screws 61.

The carrier 17 fits only the bottom end of the shell holder 14, as the bottom end of the shell holder 14 has a slightly smaller O. D. then the carrier 17. Allen head cap screws secure the carrier 17 to the percussion firing assembly.

A bull plug 21 is placed at the bottom of the carrier 17 and is fitted with two O-rings to secure a tight seal 22 and 23. This plug 21 is threaded at the bottom 24 to permit weights to be attached to it when circumstances require the perforating assembly to have added weight.

The charge holder and carrier assembly is completed by placing a 0.22 Hornet detonator with detonating cord, such as Prima Cord, attached to one end, into the vertical hole 51 in the shell holder 14. The Prima Cord is crimped into the detonator before either is placed into the shell holder 14. After crimping the cord, the end of the cord is pushed through the charge holder 16 and the detonator is seated in place at the top of the shell holder 14. The other end of the cord is placed on a single Jet charge which is usually placed in the middle circular cutout 28 of the carrier 17, although the upper cutout 30 or the lower cutout 29 could also be used.

Figure 2A:
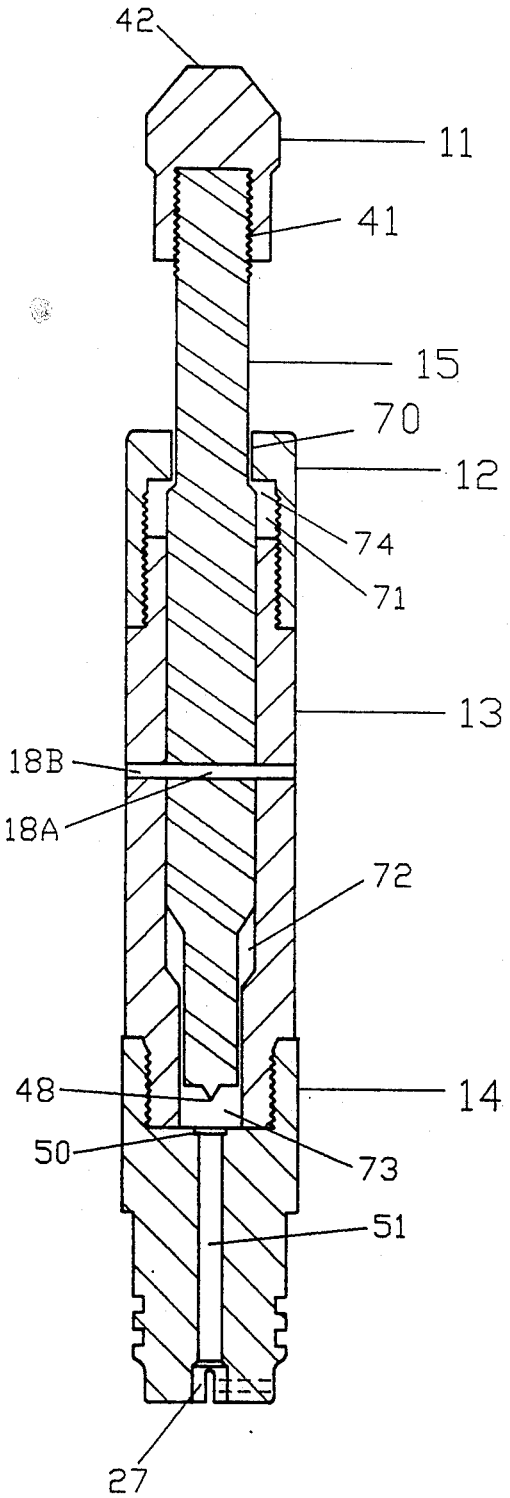
FIG. 2A shows the percussion firing assembly in a longitudinal sectional view, illustrating the firing pin prior to detonation, without the detonator in the shell holder.

FIG. 2A shows the percussion firing assembly of the perforating assembly, in a longitudinal sectional view, illustrating the firing pin 15 prior to detonation, without the detonator in the shell holder 14.

More specifically, FIG. 2A does not include the charge holder and carrier assembly, but shows only the percussion firing assembly with the firing pin 15 in its armed position. In addition, the frangible pin, not illustrated, is inserted into the holes 18A and 18B which have been drilled horizontally in the middle portion of the firing pin 15 and the middle portion of the firing pin holder 13. When the frangible pin is in place, the firing pin 15 is held in its armed position so that said percussion firing assembly will collapse when subjected to sharp force on the top 42 of the fishing neck 11. The percussion firing assembly is of greater length when said assembly is in its armed position.

The firing pin 15 is held in place by the firing pin holder cap 12. Specifically, a vertical hole 70 is drilled through the firing pin holder cap 12, having an I. D. slightly larger than the upper portion of the firing pin 15. This drilled vertical hole 70 in the firing pin holder cap 12 has a smaller diameter than the middle portion 74 of the firing pin 15. This smaller diameter 70 in said cap 12 prohibits the middle portion 74 of the firing pin 15 from rising above the firing pin holder cap 12, regardless of whether the frangible pin is in place. This smaller diameter 70 in the firing pin holder cap 12 also enables the percussion firing assembly to be disposed in its armed position, so that the firing pin 15 can be moved to strike a 0.22 Hornet detonator in the vertical hole 50 in the middle of the shell holder 14, when the firing pin 15 is subjected to a sharp force on the top 42 of the fishing neck 11.

There is a space 71 between the firing pin holder cap 12, the firing pin 15, and the firing pin holder 13. While different machining techniques could be used to eliminate this space 71, efficient and cost-effective production of the percussion firing assembly suggests otherwise.

As noted heretofore, a frangible pin is inserted into the horizontally drilled holes 18A and 18B which extend through both the firing pin 15 and the firing pin holder 13, respectively. The frangible pin will shear when said pin is subjected to sharp force at the top 42 of the fishing neck 11.

The firing pin 15 and attached fishing neck 11 is the only moving part of the percussion firing assembly. Said firing pin 15 and attached fishing neck 11 will move when subjected to a sharp force. The firing pin 15 moves when the sharp force shears the frangible pin. The firing pin 15 moves simultaneously through the firing pin holder cap 12, the firing pin holder 13, and comes to rest at the top 50 of the shell holder 14. The end point 48 of the firing pin 15 strikes a 0.22 Hornet detonator at the top of the vertical hole 50 in the shell holder 14. The space 73 between the end 48 of the firing pin 15 and the top 50 of the shell holder 14 accepts the movement of the entire firing pin 15 when it is subjected to a sharp force. The space 72 between the lower end of the firing pin 15 and the firing pin holder 13 permits the said pin 15 to move through said holder 13 and strike the 0.22 Hornet detonator in the shell holder 14 at the areas numbered 50 and 51.

Figure 2B:
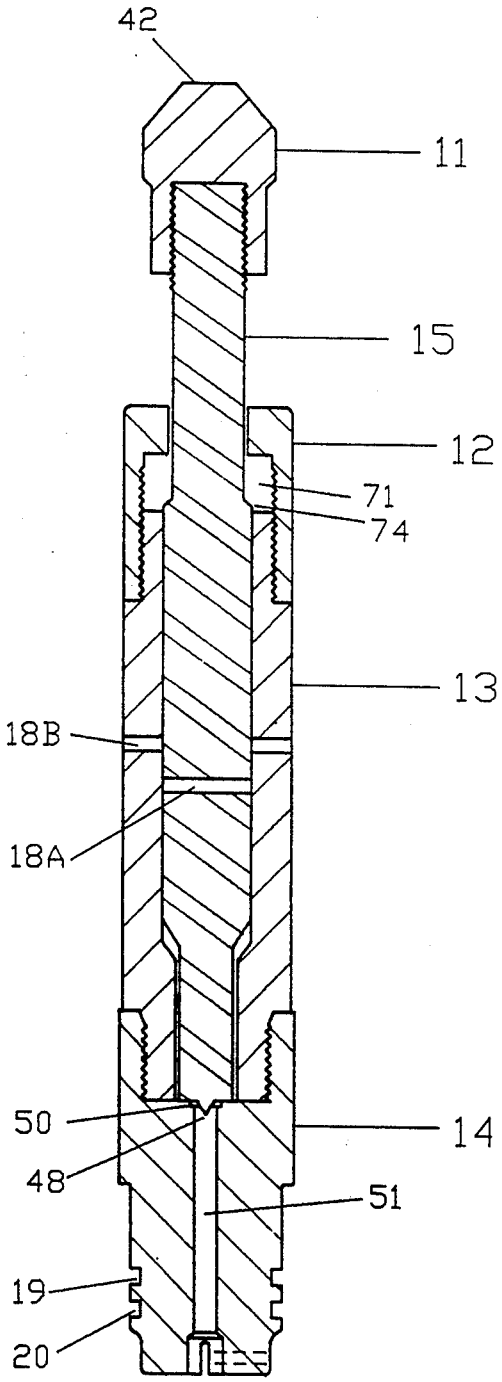
FIG. 2B shows the percussion firing assembly in a longitudinal sectional view, illustrating the firing pin after detonation.

FIG. 2B shows the percussion firing assembly of the perforating assembly in a longitudinal sectional view, illustrating the firing pin 15 after detonation without the 0.22 Hornet detonator in the shell holder 14.

More specifically, FIG. 2B depicts the percussion firing assembly with the firing pin 15 in its collapsed or detonated position. In addition, the frangible pin, not illustrated, will shear when the firing pin 15 with attached fishing neck 11 is subjected to a sharp force at the top 42 of said fishing neck 11. Thus, the resulting movement of the firing pin 15, and the detonation of the percussion firing assembly results in its shorter length.

When sharp force occurs, the pinpoint extension end 48 of the firing pin 15 meets the top 50 of the shell holder 14, said shell holder 14 accepts movement of the firing pin 15. The movement of said pin 15 when subjected to a sharp force at the top 42 of the fishing neck 11 causes the horizontally drilled hole 18A in said pin 15 to no longer be in alignment with the horizontally drilled hole 18B in the firing pin holder 13.

The end 48 of the firing pin 15, which has a sharp point, detonates the 0.22 Hornet detonator contained in the shell holder 14 at the areas numbered 50 and 51 on FIG. 2B.

Figure 3:
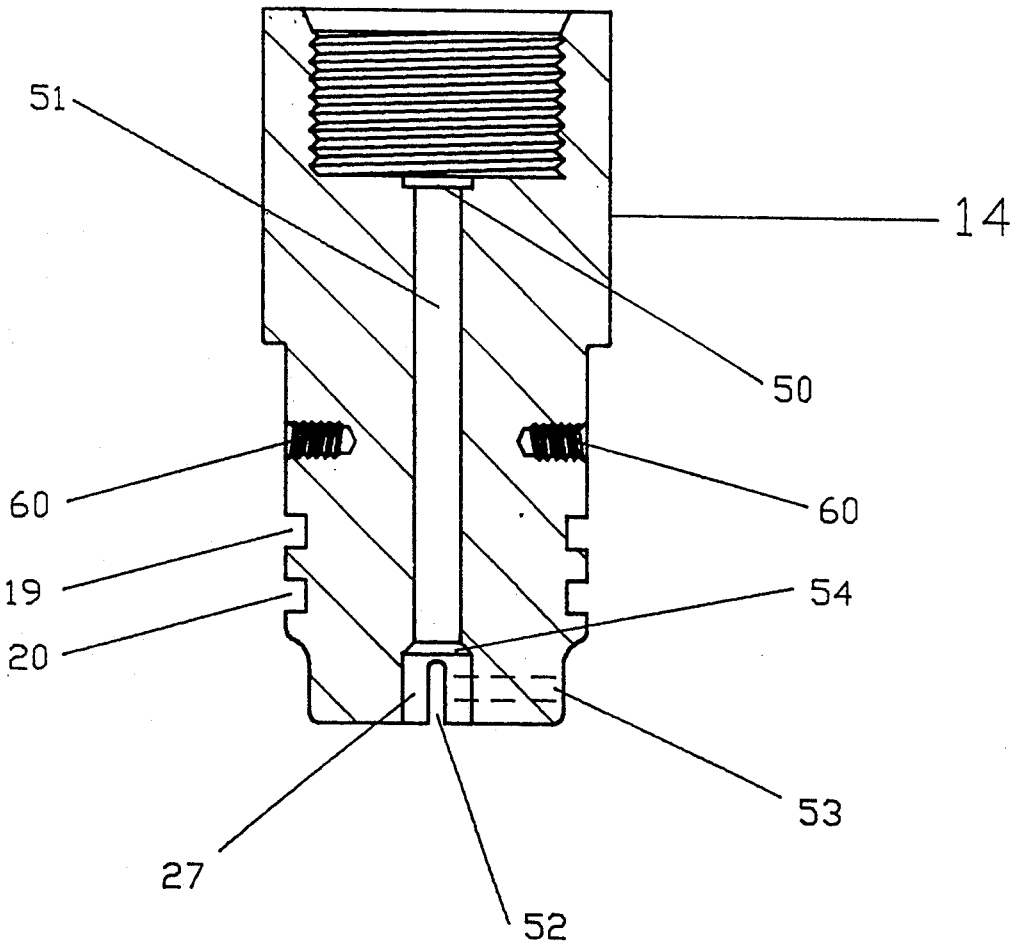
FIG. 3 shows the shell holder of the percussion firing assembly in a longitudinal sectional view, without the detonator.

FIG. 3 shows the shell holder 14 of the percussion firing assembly in a longitudinal sectional view, without the 0.22 Hornet detonator in the shell holder 14.

More specifically, FIG. 3 shows the shell holder 14 in more detail to more fully illustrate how it is machined so that it can be secured into the charge holder and carrier assembly.

A slot is cut which bisects the bottom 52 of the shell holder 14. The shell holder 14 is inserted into the charge holder at said slot 52 and is secured into place by a set of Allen head set screws. Holes 53 are drilled horizontally into said shell holder 14 near said slotted end and threaded to accept said Allen head set screws.

A flat bottom shallow hole 54 is bored into the center of the slotted end 52 of the shell holder 14, perpendicular to slot, said hole being larger than the center hole 51 which is bored through entire length of shell holder 14. This enables a charge holder to be secured into place yet leaves sufficient room to insert a detonating cord, in the area numbered 27, and into the center hole 51 of the shell holder 14.

O-rings are placed in the O-ring grooves 19 and 20 so that an appropriate seal will occur when the percussion firing assembly is placed into a hollow charge carrier. Near the middle of the shell holder 14 holes are drilled perpendicular to the center bore of said holder 14. The first hole is drilled directly in line with the milled slot 52 and the remaining holes at every 90° around circumference of said holder 14, see 60 on FIG. 3. Said holes are threaded to accept Allen head cap screws when the percussion firing assembly is inserted into a hollow charge carrier.

While the above description contains many specificities, these should not be construed as limitations on the scope of this invention, but rather as an exemplification of one perferred embodiment thereof. Other variations are possible. For example, the entire perforating assembly could be merely turned upside down, bull plug end up, and dropped "fish neck first" by hand down the tubing string, resulting in detonation when the assembly hits an obstruction: the pump or the plugged area of the tubing.

What is claimed is:

1. A method for perforating tubing inside a casing string, comprising the steps of:

a. positioning at the top of the tubing string a perforating apparatus;

b. subsequently dropping said perforating apparatus through said tubing string allowing it to hit an obstruction or plugged area in the tubing near the bottom of a well;

c. dropping an impact bar through said tubing string causing a collision with said perforating apparatus which will detonate said apparatus and create a drain hole in said tubing;

d. not removing said perforating apparatus and impact bar from said tubing prior to removal of said tubing string from a well;

e. recovering said perforating apparatus and impact bar from said tubing after said tubing string has been removed from a well.

2. A manually-dropped perforating apparatus for perforating tubing in a well with an explosive charge, comprising:

a. a percussion firing assembly machined from cylindrical lengths of solid metal, including:

i. a fishing neck drilled and threaded in the center of its bottom end to be disposed at the upper end of said percussion firing assembly by screwing said fishing neck onto a firing pin, said fishing neck machined to receive on its top the force from a dropped impact bar, and adapted for suspension from a wireline, if needed;

ii. a firing pin holder machined to receive a firing pin and disposed on top of a shell holder, said firing pin holder threaded on top to receive a firing pin holder cap and threaded at its other end so that it can be screwed into said shell holder; said firing pin holder drilled vertically to approximately the same diameter as said firing pin and at its other end drilled vertically to a smaller diameter so that said firing pin can come into contact with a detonator in a shell holder;

iii. a firing pin holder cap to be disposed at one end of a firing pin holder and adapted at said end to approximately the same diameter as one end of a firing pin, so that said firing pin holder pin cap will slide onto said firing pin after the firing pin has been inserted into said firing pin holder, and said firing pin holder cap threaded so that it will screw onto the top of said firing pin holder, so that when the firing pin holder cap is screwed into place the firing pin is prevented from being removed from said firing pin holder;

iv. a firing pin machined at one end with a small pinpoint-shaped extension so that said extension will hit a Hornet detonator in a shell holder; said firing pin with an unthreaded bottom end disposed into the top of a firing pin holder by inserting said end, which is the smallest end, into the top of said firing pin holder; and the other, upper, end of said firing pin with a diameter of a size slightly larger than the unthreaded end, so that said firing pin will accept a firing pin holder cap; and said firing pin with its middle portion having its largest diameter, said portion machined to accept a frangible pin; and said firing pin drilled through horizontally in said middle portion to produce a hole of a size which will accept a frangible pin, and so that said hole can be lined up with a hole horizontally drilled through said firing pin holder so that said firing pin holder will also accept the frangible pin, resulting in the alignment of said firing pin and said firing pin holder, so that said frangible pin can be inserted through said firing pin and said firing pin holder.

v. a shell holder disposed below a firing pin holder and above an expendable hollow charge carrier and which has been adapted to receive a 0.22 Hornet detonator, said detonator and a detonator cord being first crimped together, then said cord inserted into vertical center hole of said shell holder and said cord pulled through until said detonator seats in place; said shell holder milled at its bottom end to produce a horizontal slot bisecting said end and holes for screws drilled near said slotted end, so that said end and screws in said shell holder will hold in place a charge holder; said shell holder with an outside diameter at its slotted end such that said shell holder can be placed into said charge holder and held in place with screws; said shell holder grooved to accept two O-rings thereon; and said shell holder threaded at its top end to receive a firing pin holder;

b. the percussion firing assembly of claim 2.a. further including:

i. adapting an expendable hollow charge carrier to receive said percussion firing assembly and to secure said firing assembly by means of screws, and adapted at its lower end to receive a bull plug to be secured by screws;

ii. a charge holder which fits onto the bottom end of a shell holder and which is secured by screws;

iii. a bull plug disposed at the bottom of the perforating assembly, said plug adapted for insertion into the lower end of the charge holder and carrier assembly and fitted with two O-rings to secure a tight seal; said bull plug threaded at its bottom end so that weights can be attached if needed.

3. The perforating assembly of claim 2 wherein the firing pin is disposed within said perforating assembly so as to be moved to strike a detonator in the shell holder when said firing pin is in the armed position and is subjected to sharp force.

4. The perforating assembly of claim 2 wherein said percussion firing assembly includes a frangible pin inserted through horizontally drilled holes in the firing pin holder the firing pin so as to be sheared when said frangible pin is subjected to sharp force.

5. The perforating assembly of claim 2 wherein insertion of said frangible pin of claim 4 permits said percussion firing assembly to be held in its armed position so that said percussion firing assembly will collapse when subjected to sharp force and said firing assembly is of greater length when armed than when disarmed.

* * * * *